US010364108B2

(12) United States Patent
Daigo

(10) Patent No.: US 10,364,108 B2
(45) Date of Patent: Jul. 30, 2019

(54) SHEET FEED DEVICE AND IMAGE FORMING APPARATUS INCLUDING THE SAME

(71) Applicant: KYOCERA Document Solutions Inc., Osaka (JP)

(72) Inventor: Hironori Daigo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/016,445

(22) Filed: Jun. 22, 2018

(65) Prior Publication Data

US 2019/0002220 A1 Jan. 3, 2019

(30) Foreign Application Priority Data

Jun. 29, 2017 (JP) ..... 2017-127487

(51) Int. Cl.
*B65H 1/04* (2006.01)
*B65H 1/14* (2006.01)

(52) U.S. Cl.
CPC ..... *B65H 1/14* (2013.01); *B65H 1/04* (2013.01); *B65H 2405/1117* (2013.01); *B65H 2405/1124* (2013.01); *B65H 2405/31* (2013.01); *B65H 2405/324* (2013.01)

(58) Field of Classification Search
CPC .... B65H 1/04; B65H 1/14; B65H 2405/1117; B65H 2405/1124; B65H 2405/31; B65H 2405/324; B65H 2405/354
See application file for complete search history.

(56) References Cited

U.S. PATENT DOCUMENTS 5,228,676 A * 7/1993 Arai ..... G03G 15/6502 271/117
10,065,818 B1 * 9/2018 Nishimura ..... B65H 1/266
2011/0049789 A1 * 3/2011 Kato ..... B65H 1/14 271/162
2015/0084270 A1 * 3/2015 Lo ..... B65H 1/14 271/147

FOREIGN PATENT DOCUMENTS

JP H 07-251961 A 10/1995

* cited by examiner

*Primary Examiner* — Jeremy R Severson
(74) *Attorney, Agent, or Firm* — Stein IP, LLC

(57) ABSTRACT

The sheet feed device includes a sheet containing cassette with a sheet stacking plate therein, a sheet feed part enabled to feed a sheet within the sheet containing cassette set in a setting position, a first sensing mechanism, a lift mechanism, a drive mechanism, and a controller. The lift mechanism includes a cassette-side coupling member for transmitting driving force to the sheet stacking plate. The drive mechanism includes a main body-side coupling member coupled with the cassette-side coupling member. When the first sensing mechanism has sensed that no sheets are stacked on the sheet stacking plate, the controller makes the main body-side coupling member rotate reverse to move down the sheet stacking plate and, even after the sheet stacking plate lowers, makes the main body-side coupling member continue to be rotated reverse so as to move out the sheet containing cassette from the setting position.

6 Claims, 7 Drawing Sheets

SHEET FEED DEVICE AND IMAGE FORMING APPARATUS INCLUDING THE SAME

INCORPORATION BY REFERENCE

This application is based upon and claims the benefit of priority from the corresponding Japanese Patent Application No. 2017-127487 filed on Jun. 29, 2017, the entire contents of which are incorporated herein by reference.

BACKGROUND

The present disclosure relates to a sheet feed device including a cassette which is fittable and removable to an apparatus body and which contains therein sheets to be fed to the apparatus body. The disclosure also relates to an image forming apparatus including the sheet feed device.

In image forming apparatuses such as copiers and printers, use is made of a sheet feed cassette in which a sheet bundle of cut paper or the like is preparatorily stocked and which separates and feeds sheets one by one from the sheet bundle, starting with the topmost layer of the bundle. For such purposes as resupply of sheets and changes in sheet size, or on occasions of jam treatment, the sheet feed cassette is fitted to and removed from the main body of the image forming apparatus by a user's manual work.

Also, with an aim of preventing the sheet feed cassette from popping out during image formation, the sheet feed cassette is biased, in an insertional direction, against the image forming apparatus body. Due to this, a user would be necessitated to pull out the sheet feed cassette with a force greater than the biasing force acting on the sheet feed cassette. Furthermore, on occasions involving a large total weight of the sheet feed cassette's own weight and contained sheets' weight, operability in pulling-out the sheet feed cassette from the main body of the image forming apparatus would be deteriorated.

Accordingly, there have been proposed methods that allow the sheet feed cassette to be easily pulled out with simple structure. As an example, there is known a sheet feed cassette with a sheet pushup-pressure canceling function which includes: a push-up member whose one end is pivotably attached on a bottom plate of a sheet feed cassette body and whose other end pushes up an other-end lower surface of a sheet mounting plate; a biasing means for upwardly biasing the other end of the push-up member; a pushup-pressure canceling means which operates in linkage with the pushup member to cancel a sheet pushup pressure applied to the sheet mounting plate by the biasing means; and a pushup-pressure cancellation actuating member for actuating the pushup-pressure canceling means in a sheet-feed-cassette pull-out position.

SUMMARY

A sheet feed device according to an aspect of the present disclosure includes a sheet containing cassette, a sheet feed part, a first sensing mechanism, a lift mechanism, a drive mechanism, and a controller. The sheet containing cassette includes a sheet containing part for containing sheets therein, and a sheet stacking plate whose sheet-feed-direction downstream-side one end is pivotably supported by a bottom face of the sheet containing part and in which the sheets are to be stacked on its top surface. The sheet feed part is enabled to retain the sheet containing cassette in an insertable-and-withdrawable manner and to feed the sheets stacked on the sheet stacking plate with the sheet containing cassette set in a setting position. The first sensing mechanism senses presence or absence of the sheets stacked on the sheet stacking plate. The lift mechanism is provided in the sheet containing cassette and configured to move up and down the sheet stacking plate. The drive mechanism is provided in the sheet feed part and configured to transmit driving force to the lift mechanism. The controller controls drive of the drive mechanism based on a sensing result by the first sensing mechanism. The lift mechanism includes a cassette-side coupling member for transmitting driving force to an actuating plate that lifts up a sheet-feed-direction downstream-side end portion of the sheet stacking plate. The drive mechanism includes a main body-side coupling member to be coupled with the cassette-side coupling member. When the first sensing mechanism has sensed that the sheets are stacked on the sheet stacking plate, the controller makes the main body-side coupling member rotate forward to move up the sheet stacking plate and moreover feed out a specified number of sheets. During or after feeding of the sheets, when the first sensing mechanism has sensed that none of the sheets are stacked on the sheet stacking plate, the controller makes the main body-side coupling member rotate reverse to move down the sheet stacking plate and, even after the sheet stacking plate lowers to the bottom face, makes the main body-side coupling member continue to be rotated reverse so that pressing force in a thrust direction acts from the main body-side coupling member onto the cassette-side coupling member to move out the sheet containing cassette from the setting position.

Further objectives of the present disclosure as well as specific advantages obtained by the disclosure will become more apparent from the description of an embodiment given below.

DETAILED DESCRIPTION

Figure 1:
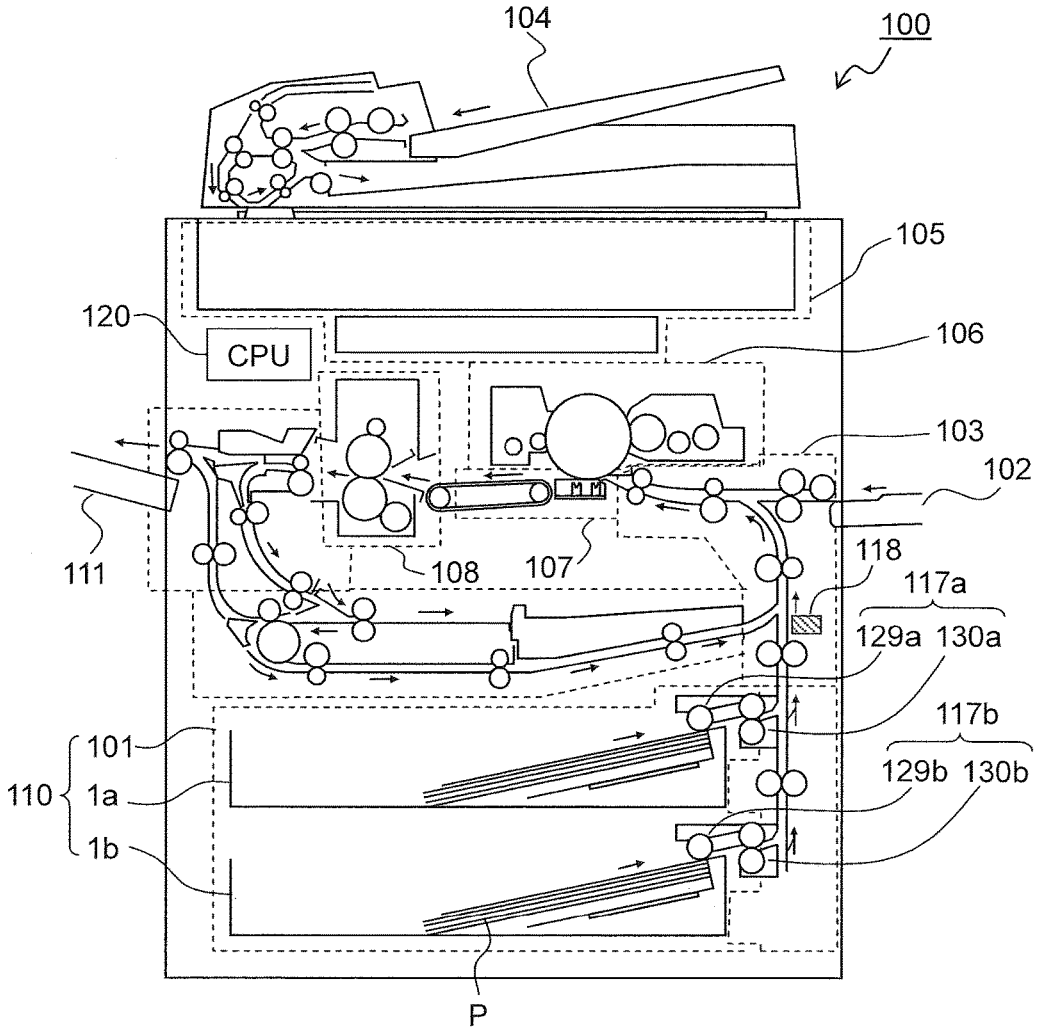
FIG. 1 is a schematic sectional view showing an internal structure of an image forming apparatus including a sheet feed device according to one embodiment of the present disclosure.

Hereinbelow, an embodiment of the present disclosure will be described with reference to the accompanying drawings. FIG. 1 is a side sectional view showing an internal structure of an image forming apparatus 100 including a sheet feed device 110 according to one embodiment of the disclosure. It is noted that solid-line arrows in the figure indicate conveyance paths and conveyance directions of a paper sheet P.

Referring to FIG. 1, a cassette type sheet feed part 101 is located in lower part of the image forming apparatus 100. Two sheet feed cassettes 1*a*, 1*b* are provided in the cassette type sheet feed part (sheet feed part) 101. Inside these sheet feed cassettes 1*a*, 1*b*, bundles of sheets P of paper such as unprinted cut paper are stacked and contained. The sheets P are separated and fed out, one by one, from the bundles of sheets P by sheet feed units 117*a*, 117*b* included in the main body of the image forming apparatus 100. The sheet feed unit 117*a* has a pickup roller 129*a* and a sheet feed roller pair 130*a* provided in correspondence to the sheet feed cassette 1*a*. The sheet feed unit 117*b* has a pickup roller 129*b* and a sheet feed roller pair 130*b* provided in correspondence to the sheet feed cassette 1*b*. The sheet feed cassettes 1*a*, 1*b* and the cassette type sheet feed part 101 constitute the sheet feed device 110 of the disclosure.

A manual sheet feed part 102 is provided outside a right-side-face upper portion of the image forming apparatus 100. To be mounted on the manual sheet feed part 102 are paper sheets different in size or thickness from those for the cassette type sheet feed part 101, OHP sheets, envelopes, postcards, invoices, and others that are to be fed in on a one-sheet basis.

A sheet conveyance part 103 is located in the image forming apparatus 100. The sheet conveyance part 103 is positioned rightward, i.e. sheet-feed-direction downstream, of the cassette type sheet feed part 101. The sheet conveyance part 103 is positioned leftward, i.e. sheet-feed-direction downstream, of the manual sheet feed part 102. A sheet P fed out from the sheet feed device 110 is conveyed vertically upward along a side face of the main body of the image forming apparatus 100 by the sheet conveyance part 103. A sheet P fed out from the manual sheet feed part 102 is conveyed horizontally by the sheet conveyance part 103.

A document conveyance device 104 is located on a top surface of the image forming apparatus 100, and an image reading part 105 is located downward of the document conveyance device 104. In executing document copy, a user stacks a plurality of document sheets on the document conveyance device 104. The document sheets are separated and fed out one by one by the document conveyance device 104, and then image data of the sheets are read by the image reading part 105.

An image forming part 106 and a transfer part 107 are located sheet-feed-direction downstream of the sheet conveyance part 103 and downward of the image reading part 105. In the image forming part 106, an electrostatic latent image of a document image is formed based on image data read by the image reading part 105, and the electrostatic latent image is developed to form a toner image. Meanwhile, in synchronization with a timing at which the toner image is formed in the image forming part 106, a sheet P is conveyed from the cassette type sheet feed part 101 via the sheet conveyance part 103 to the transfer part 107. The toner image formed in the image forming part 106 is transferred onto the sheet P in the transfer part 107.

A fixing part 108 is located downstream of the transfer part 107. The sheet P, onto which the toner image has been transferred in the transfer part 107, is conveyed to the fixing part 108. In the fixing part 108, the sheet P passes through a nip portion of a fixing roller pair composed of a heating roller and a pressure roller, by which the toner image on the sheet P is fixed so as to be formed into a permanent image. The sheet P discharged from the fixing part 108 is discharged onto a sheet discharge tray 111 provided outside a left side face of the image forming apparatus 100.

Further provided in the image forming apparatus 100 is a controller 120 for controlling drive of individual parts configuring the image forming apparatus 100 such as the cassette type sheet feed part 101, the sheet conveyance part 103, the image reading part 105, the image forming part 106, the transfer part 107, and the fixing part 108.

Figure 2:
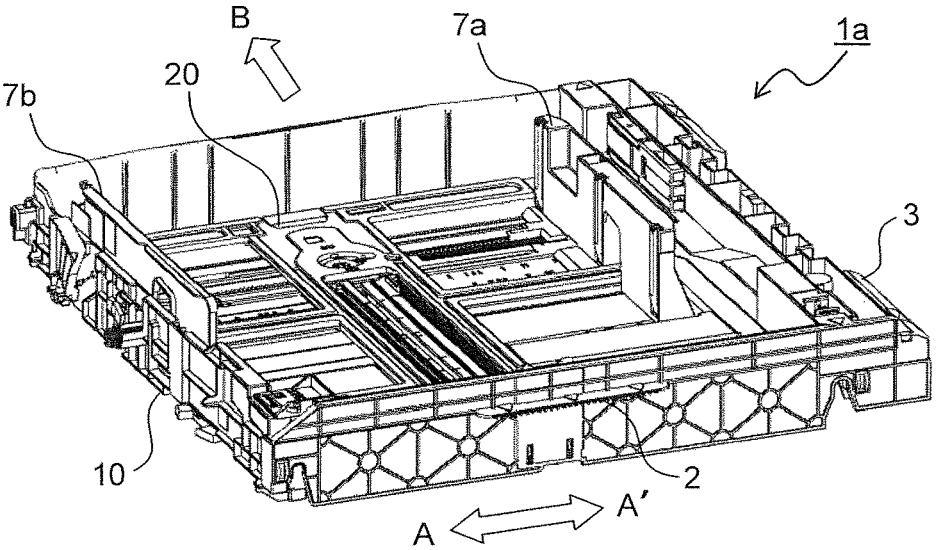
FIG. 2 is a perspective view of a sheet feed cassette forming the sheet feed device of this embodiment, as viewed from an upstream side of a sheet feed direction.
Figure 3:
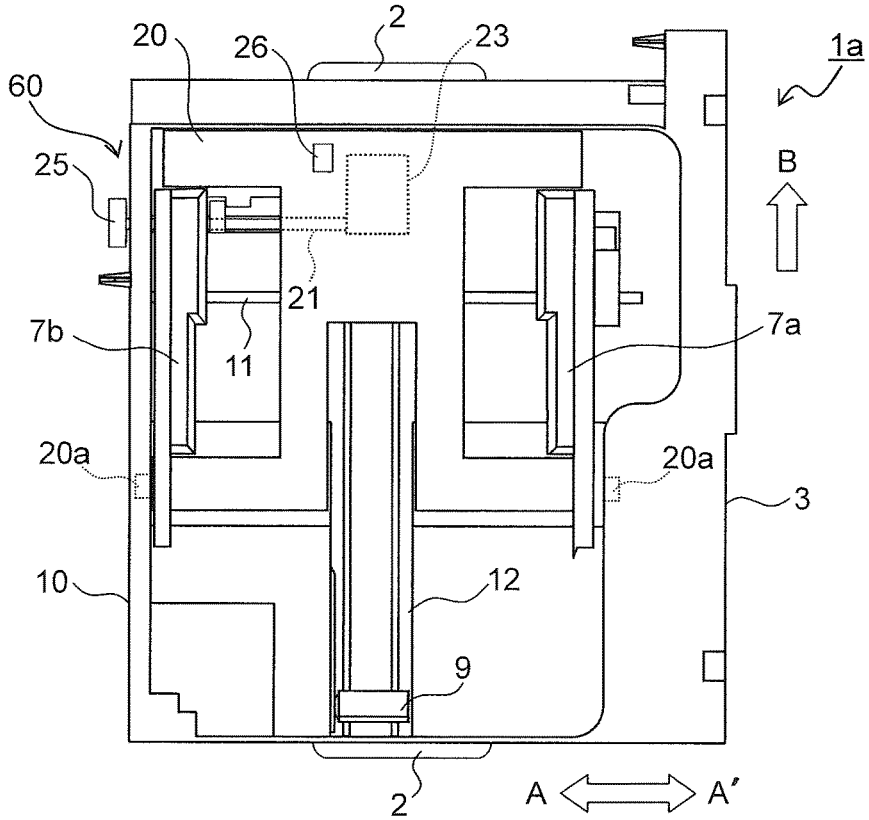
FIG. 3 is a plan view of the sheet feed cassette.

Next, a detailed structure of the sheet feed cassette 1*a*, which is used fittably and removably to the image forming apparatus 100, will be described with reference to FIGS. 2 and 3. FIG. 2 is an appearance perspective view of the sheet feed cassette 1*a*, as viewed from the upstream side of the sheet feed direction. FIG. 3 is a plan view of the sheet feed cassette 1*a*. Although here is described a configuration of the sheet feed cassette 1*a*, the sheet feed cassette 1*b* is absolutely identical in configuration thereto. In FIGS. 2 and 3, arrow A denotes an insertional direction of the sheet feed cassette 1*a* to the cassette type sheet feed part 101, arrow A' denotes its pull-out direction, and arrow B denotes a sheet feed direction of the sheet feed cassette 1*a*.

The sheet feed cassette 1*a* is contained in the cassette type sheet feed part 101 of the image forming apparatus 100 shown in FIG. 1. A cassette base 10 (sheet containing part), which is a body portion of the sheet feed cassette 1*a*, is formed of a flat box with a top face opened, allowing sheets P to be stacked and contained from the top face side. In the cassette type sheet feed part 101 within the image forming apparatus 100, a sheet feed unit 117*a* (see FIG. 1) is provided upward of the sheet feed cassette 1*a*, so that the sheet P (see FIG. 1) is fed in an arrow B direction shown in FIG. 2. A cassette cover 3 is fitted in front part of the cassette base 10. The cassette cover 3 has its surface side (left side in FIG. 3) exposed outside so as to form part of external surfaces of the main body of the image forming apparatus 100.

A guide rib 2 is provided outside a side face of the cassette base 10 parallel to its pull-out direction (arrow AA' direction). With the guide rib 2 engaged with an unshown rail inside the cassette type sheet feed part 101, the sheet feed cassette 1*a* is slid horizontally in the arrow A direction shown in FIG. 2 so as to be inserted into the cassette type sheet feed part 101.

A sheet stacking plate 20 on which sheets P are to be stacked is a plate-shaped member. The sheet stacking plate 20 is provided such that its sheet-feed-direction (arrow-B-direction) downstream end is up/down movable, with left/right rocking shafts 20*a* used as fulcra, relative to the cassette base 10.

Further, on widthwise both sides of the sheet stacking plate 20, a pair of width-restricting cursors 7*a*, 7*b* for performing widthwise positioning of sheets P stacked on the sheet stacking plate 20 are provided so as to be reciprocatively movable each in the sheet widthwise direction (arrow AA' direction) along a width-restricting cursor guide groove 11 formed in the cassette base 10. Also, in the sheet feed cassette 1*a*, a rear-end cursor 9 is provided to align a rear end of sheets P stacked on the sheet stacking plate 20 by virtue of the setting of the rear-end cursor 9 at a position responsive to a size of the sheets P. Since a sheet P is fed out in the arrow B direction toward the sheet conveyance part 103 (see FIG. 1), the rear-end cursor 9 serving to align the rear end of the sheets P is provided so as to be reciprocatively movable in the sheet feed direction (arrow B direction) along rear-end cursor guide grooves 12 formed in the cassette base 10.

The width-restricting cursors 7*a*, 7*b* and the rear-end cursor 9 are moved in accordance with a size of sheets P to be stacked on the sheet stacking plate 20, so that the sheets P are set and contained at a specified position in the sheet feed cassette 1*a*. The sheet stacking plate 20 has cutouts over moving regions of the width-restricting cursors 7*a*, 7*b* and the rear-end cursor 9.

An actuating plate 23 which is fixed at an end of a rocking shaft 21 to push up a rocking end of the sheet stacking plate 20 is provided on the back side of the sheet stacking plate 20. A cassette-side coupling member 25 is provided at the other end of the rocking shaft 21. The cassette-side coupling member 25, which is protruded on the insertional-direction downstream side of the cassette base 10, is to be coupled to a main body-side coupling member 27 (see FIG. 4) when the sheet feed cassette 1*a* is inserted into a specified position of the main body of the image forming apparatus 100. The rocking shaft 21, the actuating plate 23, and the cassette-side coupling member 25 constitute a lift mechanism 60 for moving up and down the rocking end of the sheet stacking plate 20.

Figure 4:
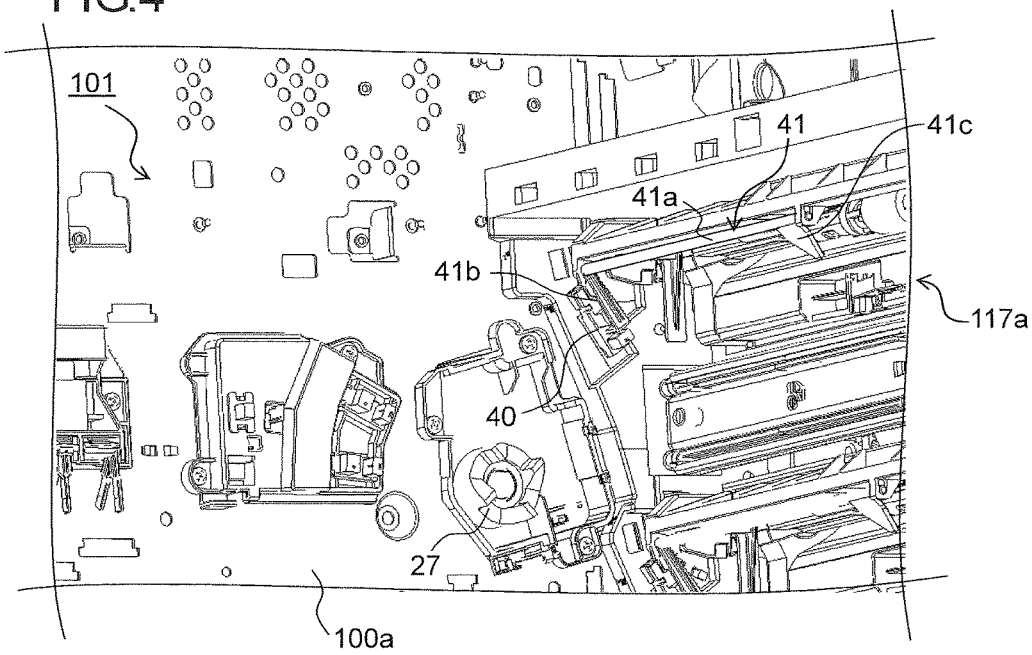
FIG. 4 is a partial perspective view of around a sheet feed unit of a cassette type sheet feed part.

FIG. 4 is a partial perspective view of around the sheet feed unit 117*a* of the cassette type sheet feed part 101. As shown in FIG. 4, the sheet feed unit 117*a* is fittably and removably supported by the cassette type sheet feed part 101 formed between a pair of side frames 100*a*, 100*b* (in FIG. 4, side frame 100*b* on the front-face side is not shown) which are located on back face side and front face side, oppositely, of the image forming apparatus 100.

The main body-side coupling member 27 is located on the side frame 100*a*. The main body-side coupling member 27 is to be engaged with the cassette-side coupling member 25 (see FIG. 3) provided on a side face of the sheet feed cassette 1*a* when the sheet feed cassette 1*a* is inserted into a specified position (insertional position) of the cassette type sheet feed part 101.

With the image forming apparatus 100 powered on, inserting the sheet feed cassette 1*a* into the insertional position within the cassette type sheet feed part 101 causes a cassette detection switch (not shown) to be turned on. As a result, insertion of the sheet feed cassette 1*a* is detected. Furthermore, the main body-side coupling member 27 is engaged with the cassette-side coupling member 25, allowing driving force to be transferred to the rocking shaft 21 (see FIG. 3) via the main body-side coupling member 27 and the cassette-side coupling member 25.

In the cassette type sheet feed part 101, a PE (Paper Empty) sensor 40, as well as a PE sensing actuator 41, for sensing presence or absence of paper sheets in the sheet feed cassette 1*a* are provided. The PE sensor 40 is a PI (photointerrupter) sensor in which a sensing part composed of a light-emitting part and a light-receiving part is provided on opposed inner surfaces that are formed into a U shape as viewed in a plan view.

The PE sensing actuator 41 includes a shaft 41*a*, a light-shield plate 41*b*, and a contact piece 41*c*. The shaft 41*a*, as it is pivotably supported, extends from deeper side toward central part of the sheet feed unit 117*a*. The light-shield plate 41*b* is formed at deeper-side one end (outside the paper-passing area) of the shaft 41*a* to shut off or open an optical path of the sensing part of the PE sensor 40. The contact piece 41*c* is formed at the center-sided other end of the shaft 41*a* so as to make contact with the paper sheet bundle P in the sheet feed cassette 1*a*. FIG. 4 shows a state in which the sheet feed cassette 1*a* has not been inserted, where the optical path of the sensing part of the PE sensor 40 is shut off by the light-shield plate 41*b*, with the light-reception signal level of the PE sensor 40 set to a LOW state. The PE sensor 40 and the PE sensing actuator 41 constitute a first sensing mechanism for sensing the presence or absence of any paper sheet set on the sheet stacking plate 20.

After the insertion of the sheet feed cassette 1*a* with the sheet bundle P stacked on the sheet stacking plate 20, moving up the sheet stacking plate 20 to a specified extent causes the contact piece 41*c* to be pressed by the sheet bundle P, so that the PE sensing actuator 41 is rocked and the light-shield plate 41*b* is pivoted upward as viewed in FIG. 4. As a result, the light-shield plate 41*b* is withdrawn from the sensing part of the PE sensor 40, making the optical path of the sensing part to be opened. Thus, the light-reception signal level of the PE sensor 40 is switched from LOW to HIGH.

A slit 26 (see FIG. 3) that allows the contact piece 41*c* of the PE sensing actuator 41 to pass through is formed in the sheet stacking plate 20. As paper sheets in the sheet feed cassette 1*a* decrease due to printing operation, the sheet stacking plate 20 moves up to an extent corresponding to the decrease. Therefore, the PE sensing actuator 41 is maintained at a constant angle. When the paper sheets in the sheet feed cassette 1*a* have been emptied, the contact piece 41*c* is let to pass through the slit 26 of the sheet stacking plate 20, causing the PE sensing actuator 41 to be pivoted downward into the state of FIG. 4. As a result, the light-shield plate 41*b* shuts off the optical path of the sensing part, so that the light-reception signal level of the PE sensor 40 is switched to LOW again. Thus, it is possible to sense the emptiness of paper sheets in the sheet feed cassette 1*a*. In addition, although the above description has been made on the sensing of presence or absence of paper sheets in the sheet feed cassette 1*a* by the PE sensor 40 and the PE sensing actuator 41 corresponding to the sheet feed cassette 1*a*, yet the case is absolutely the same also with the sensing of presence or absence of paper sheets in the sheet feed cassette 1*b*.

Figure 5:
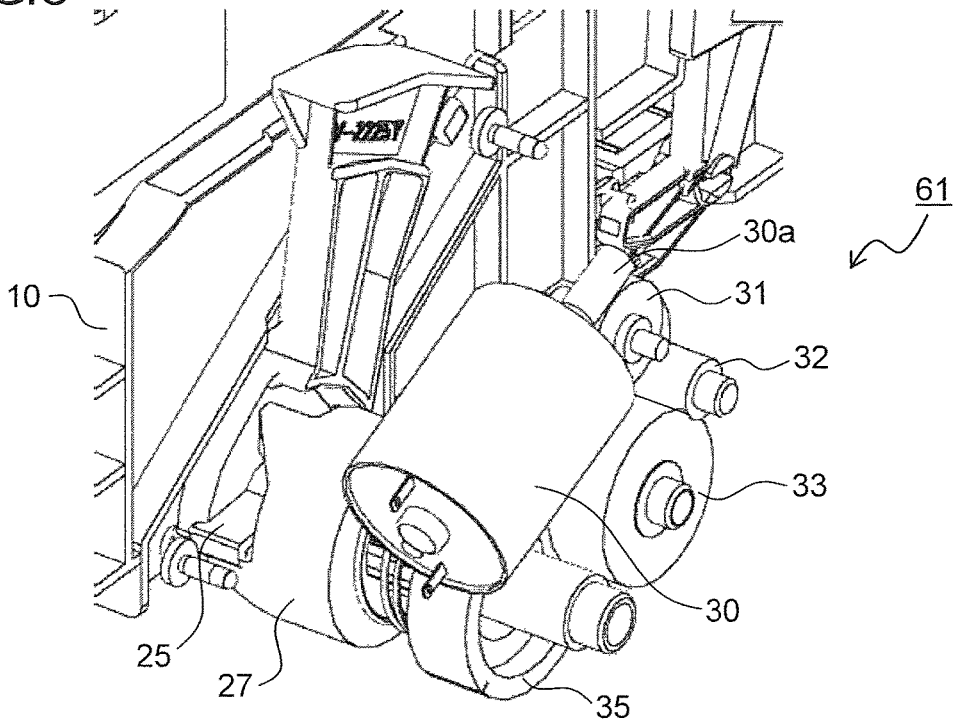
FIG. 5 is a perspective view showing a structure of around a drive mechanism provided in the cassette type sheet feed part.

FIG. 5 is a perspective view showing a structure of around a drive mechanism 61 provided in the cassette type sheet feed part 101. A state in which the sheet stacking plate 20 has been moved up is shown in FIG. 5, where the side frame 100*a* is omitted in depiction. A lift motor 30 serving as a drive source for the sheet stacking plate 20 is provided in the cassette type sheet feed part 101. A pinion 30*a* of the lift motor 30 is coupled to a drive input gear 35 via idle gears 31, 32, 33 operative for decelerating rotations of the lift motor 30. The drive input gear 35 feeds an input of driving force to the main body-side coupling member 27. The lift motor 30, the idle gears 31, 32, 33, the drive input gear 35, and the main body-side coupling member 27 constitute the drive mechanism 61 for transmitting driving force to the lift mechanism 60 that lifts and lowers the sheet stacking plate 20.

Figure 6:
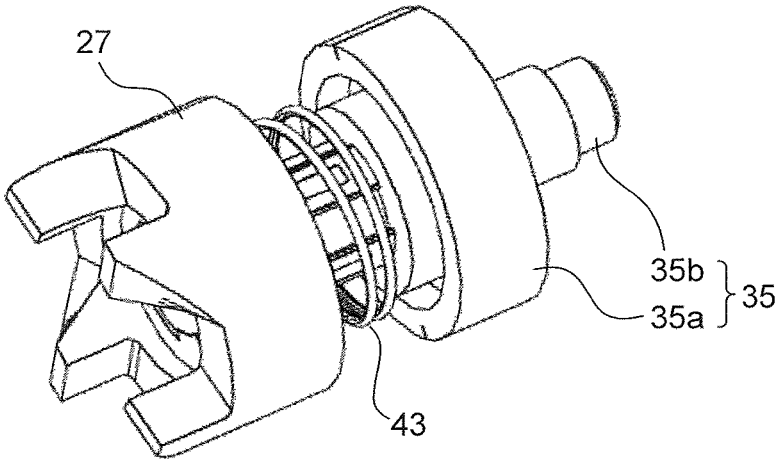
FIG. 6 is an enlarged perspective view showing a state in which a main body-side coupling member and a drive input gear are coupled together.
Figure 7:
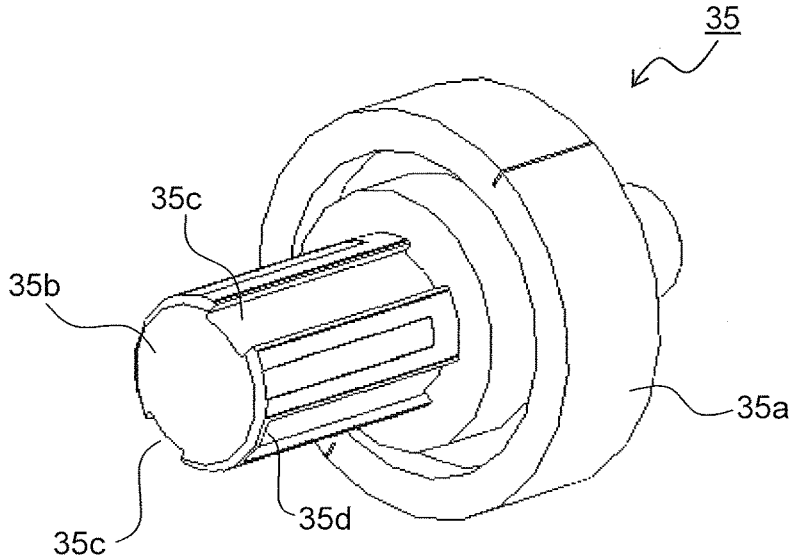
FIG. 7 is an enlarged perspective view of the drive input gear.
Figure 8:
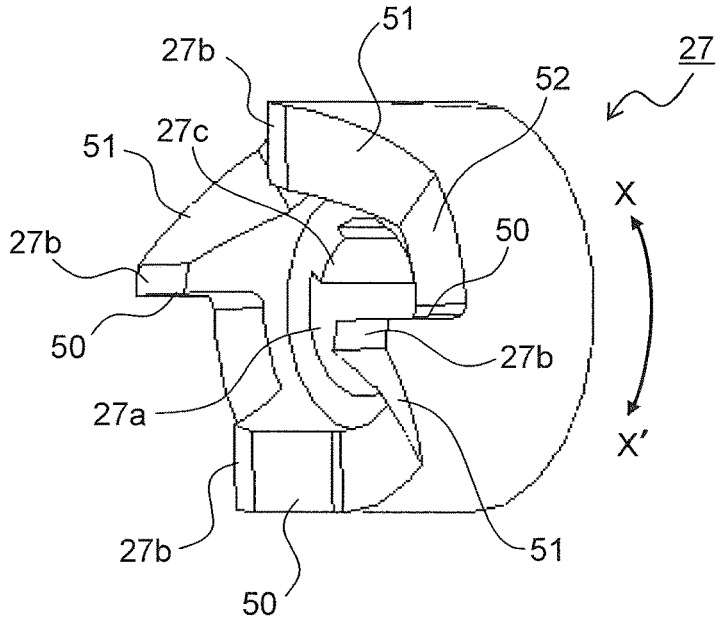
FIG. 8 is an enlarged perspective view of the main body-side coupling member.

FIG. 6 is an enlarged perspective view showing a state in which the main body-side coupling member 27 and the drive input gear 35 are coupled together. FIGS. 7 and 8 are enlarged perspective views of the drive input gear 35 and the main body-side coupling member 27, respectively. The drive input gear 35 includes a gear portion 35*a* to be meshed with gear teeth of the idle gear 33 and (see FIG. 5), and a rotating shaft 35*b* integrally formed with the gear portion 35*a*. As shown in FIG. 7, the rotating shaft 35*b* is formed into an oval shape in cross section, and groove portions 35*c* are formed along an axial direction at opposed two places, respectively, on the outer circumferential surface of the rotating shaft 35*b*. A step gap portion 35*d* is formed near a distal end portion of the rotating shaft 35*b* of the drive input gear 35.

As shown in FIG. 8, a bearing hole 27*a* into which the rotating shaft 35*b* of the drive input gear 35 is to be inserted is formed at a rotational center of the main body-side coupling member 27. A plurality (four in this case) of engaging claws 27*b* to be engaged with an engaging rib 25*b* (engaging piece, see FIG. 9) of the cassette-side coupling member 25 are protrusively provided in peripheral edge portion of the bearing hole 27*a*. Also, protruding portions 27*c* are formed along the axial direction at opposed two places on the inner circumferential surface of the bearing hole 27*a*. The protruding portions 27*c* are to be engaged with groove portions 35*c* formed on the outer circumferential surface of the rotating shaft 35*b* when the rotating shaft 35*b* of the drive input gear 35 is inserted into the bearing hole 27*a* of the main body-side coupling member 27. As a result of this, the main body-side coupling member 27, while restricted in rotation relative to the rotating shaft 35*b* of the drive input gear 35, is rotated integrally with the rotating shaft 35*b* and moreover supported so as to be movable in the axial direction (thrust direction).

A first engaging surface 50 is formed on rotational-direction one side of the main body-side coupling member 27, and a second engaging surface 51 is formed on the other side, with the engaging claws 27*b* interposed therebetween. Also, a flat coupling surface 52 is formed between the first engaging surface 50 and the second engaging surface 51. The first engaging surface 50 is a surface perpendicular to the rotational direction (arrow XX' direction) of the main body-side coupling member 27, and the second engaging surface 51 is an inclined surface having a specified inclination angle relative to the rotational direction of the main body-side coupling member 27. The coupling surface 52 is a flat surface parallel to the rotational direction of the main body-side coupling member 27.

Further, a coil spring 43 is sandwiched between the gear portion 35*a* of the drive input gear 35 and the main body-side coupling member 27, so that the main body-side coupling member 27 is pressed against the cassette-side coupling member 25 by biasing force of the coil spring 43. In this case, a restricting claw (not shown) protruding radially inward from the bearing hole 27*a* of the main body-side coupling member 27 is hooked on the step gap portion 35*d* of the rotating shaft 35*b* so as to serve as an anti-loosening mechanism for the main body-side coupling member 27 from the rotating shaft 35*b*.

Figure 9:
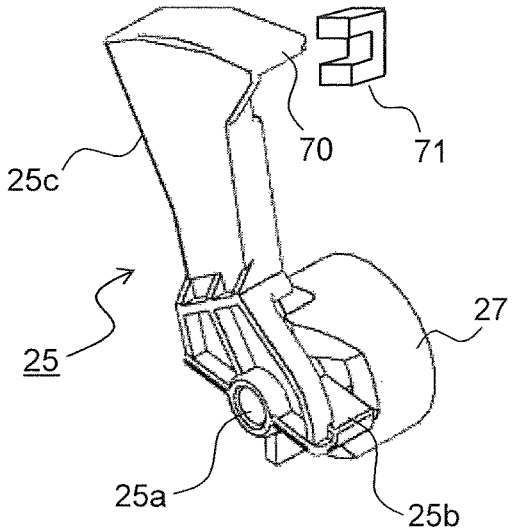
FIG. 9 is a perspective view of a cassette-side coupling member to be engaged with the main body-side coupling member, as viewed from a cassette base side.

FIG. 9 is a perspective view of the cassette-side coupling member 25 to be engaged with the main body-side coupling member 27, as viewed from the cassette base 10 side. The cassette-side coupling member 25 includes an insertion hole 25*a* into which one end of the rocking shaft 21 (see FIG. 3) is to be inserted and fixed, the engaging rib 25*b* to be engaged with the engaging claws 27*b* of the main body-side coupling member 27, and a lever portion 25*c* that protrudes radially. A light-shield plate 70 is formed in the lever portion 25*c* so that a rocking of the sheet stacking plate 20 up to the uppermost position is detected when the cassette-side coupling member 25 has turned to a position where the light-shield plate 70 shields the optical path of the sensing part of an angle sensor 71 provided in the cassette type sheet feed part 101 for sensing an angle of the sheet stacking plate 20 within the sheet feed cassette 1*a*. In addition, although one angle sensor 71 alone is depicted in FIG. 9, yet actually a plurality of angle sensors 71 are disposed along a track of the light-shield plate 70.

Figure 10:
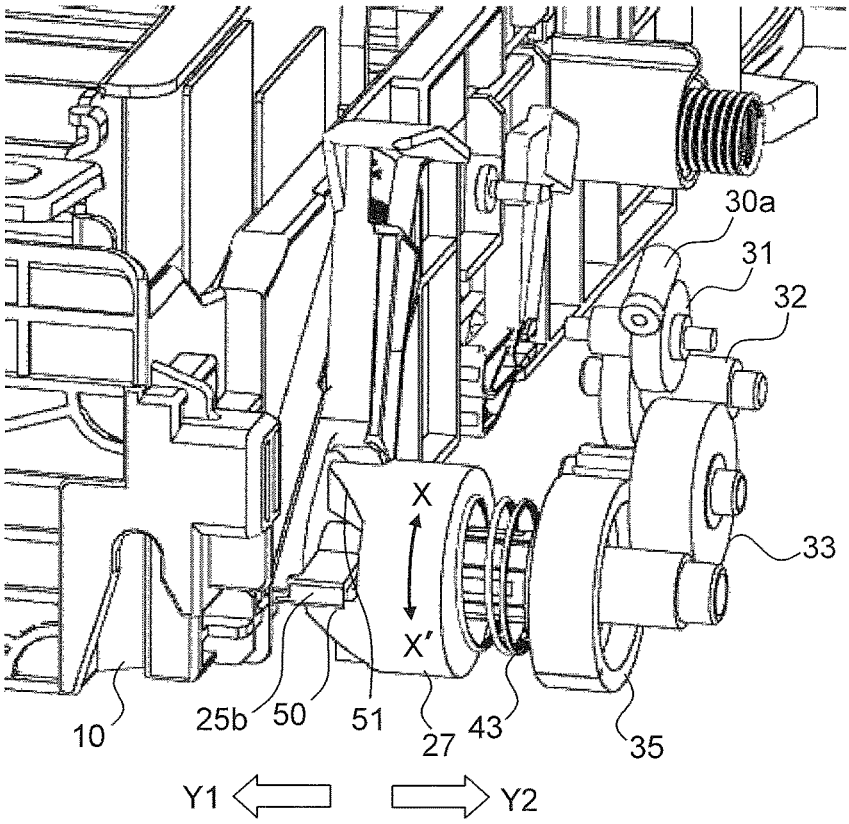
FIG. 10 is a perspective view showing a structure of around the drive mechanism, as the coupling part between the cassette-side coupling member and the main body-side coupling member is viewed in a direction generally perpendicular to an axial direction.

FIG. 10 is a perspective view showing a structure of around the drive mechanism 61, as the coupling part between the cassette-side coupling member 25 and the main body-side coupling member 27 is viewed in a direction generally perpendicular to the axial direction. FIG. 10 shows a state in which the sheet stacking plate 20 has been moved up. Move-up/down operations of the sheet stacking plate 20, as well as push-out operation of the sheet feed cassette 1*a* as a characteristic part of this disclosure, will be described below by using FIG. 10 and, as necessary, with reference to FIGS. 1 to 9.

With the sheet feed cassette 1*a* having been pulled out from the cassette type sheet feed part 101, the cassette-side coupling member 25 is not coupled to the main body-side coupling member 27 while the sheet stacking plate 20 is laid flat along the bottom face of the cassette base 10. With the bundle of sheets P stacked on the sheet stacking plate 20, inserting the sheet feed cassette 1*a* up to the specified position (insertional position) of the cassette type sheet feed part 101 causes the cassette-side coupling member 25 to be coupled to the main body-side coupling member 27.

The sheet feed cassette 1*a* is retained in the cassette type sheet feed part 101 with a specified retaining force so as to be prevented from popping out in the pull-out direction during printing process. As means for retaining the sheet feed cassette 1*a*, there may be mentioned: for example, a means in which a U-shaped engaging portion formed on the sheet feed cassette 1*a* side is elastically deformed so as to be engaged with a boss on the cassette type sheet feed part 101 side; a means in which an up/down rockable hook is provided on the sheet feed cassette 1*a* side so as to be engaged with a chevron-shaped protruding portion on the cassette type sheet feed part 101; a means which employs a unit that applies an insertional-direction biasing force to the sheet feed cassette 1*a* when the sheet feed cassette 1*a* has been inserted up to the specified position immediately before the insertional position; and other means.

In this state, rotating the lift motor 30 in a specified direction causes rotation driving force to be transferred to the main body-side coupling member 27 via the idle gears 31 to 33 and the drive input gear 35, so that the main body-side coupling member 27 is rotated (forward rotation) in a lift-up direction (arrow X direction). Along with the rotation of the main body-side coupling member 27, the engaging rib 25*b* of the cassette-side coupling member 25 is pressed against the first engaging surface 50 of the main body-side coupling member 27, so that the cassette-side coupling member 25 is rotated in the lift-up direction.

As a result, the rocking shaft 21, to which the cassette-side coupling member 25 is fixed, is turned so that the actuating plate 23 fixed to one end of the rocking shaft 21 is rocked so as to rise from the bottom face of the cassette base 10, causing the downstream end of the sheet stacking plate 20 to be lifted. Thus, the uppermost surface of the bundle of the sheets P stacked on the sheet stacking plate 20 comes into contact with the pickup roller 129*a* (see FIG. 1) of the sheet feed unit 117*a* provided in the cassette type sheet feed part 101.

Figure 11:
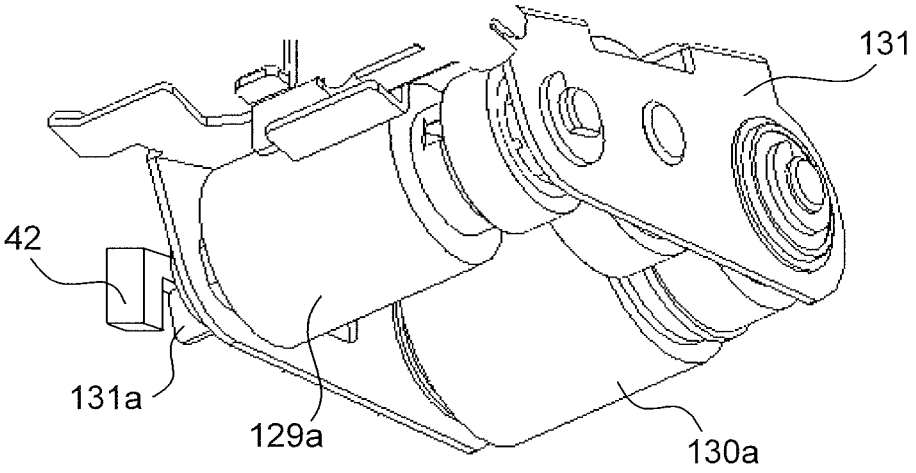
FIG. 11 is a perspective view of a roller holder that holds a pickup roller as viewed from below.

FIG. 11 is a perspective view of a roller holder 131 that holds the pickup roller 129*a* as viewed from below. The roller holder 131 is rockably supported by the sheet feed unit 117*a* on a rocking fulcrum given by the rotating shaft of the upper roller of the sheet feed roller pair 130*a*. A top surface sensor 42 is located nearby the roller holder 131. As the sheet stacking plate 20 is moved up during sheet feed operation, the top surface of the sheets P stacked on the sheet stacking plate 20 comes into contact with the pickup roller 129*a*, so that the pickup roller 129*a* is pushed up along with the roller holder 131. As a result, a light-shield plate 131*a* formed in the roller holder 131 shields an optical path of the sensing part of the top surface sensor 42, causing the light-reception signal level of the sensing part to be switched from HIGH to LOW, by which a height of the pickup roller 129*a*, i.e., a top surface position of the sheets P can be sensed. When the top surface position of the sheets P has been sensed by the top surface sensor 42, the rotation of the lift motor 30 is stopped.

Upon input of a print command, a control signal is transmitted from the controller 120 to the cassette type sheet feed part 101 to make the pickup roller 129*a* and the sheet feed roller pair 130*a* driven into rotation. By this rotation, the sheets P are separated, sheet by sheet, and conveyed to the sheet conveyance part 103. The sheets P on the sheet stacking plate 20 decrease more and more as the sheets P are fed out more and more. Therefore, while the top surface position of the sheets P is being sensed by the top surface sensor 42, the lift motor 30 is gradually rotated forward so that the downstream end of the sheet stacking plate 20 is maintained at the specified height (sheet feed position).

When it is sensed by the PE sensor 40 and the PE sensing actuator 41 (see FIG. 4) that all of the sheets P on the sheet stacking plate 20 have been fed out, the controller 120 makes the lift motor 30 rotated reverse. As a result, rotation driving force is transferred to the main body-side coupling member 27 via the idle gears 31 to 33 and the drive input gear 35, causing the main body-side coupling member 27 to be rotated (reverse rotation) in a lift-down direction (arrow X' direction). As the main body-side coupling member 27 is rotated, the engaging rib 25*b* of the cassette-side coupling member 25 is pressed against the second engaging surface 51 of the main body-side coupling member 27.

Since the second engaging surface 51 is inclined relative to the rotational direction (arrow X' direction), a component force in the rotational direction (arrow X' direction) and a component force in the thrust direction (arrow Y1 direction) act on the engaging rib 25*b*. In this case, the sheet feed cassette 1*a* is retained in the cassette type sheet feed part 101 with a specified retaining force, and the main body-side coupling member 27 is biased by the coil spring 43 in such a direction (arrow Y1 direction) as to be coupled to the cassette-side coupling member 25. Accordingly, before the sheet stacking plate 20 reaches the bottom face of the cassette base 10, there is such a large resistance in the thrust direction (arrow Y1 direction) that the engaging rib 25*b* is blocked from moving on the second engaging surface 51, so that movements of the cassette-side coupling member 25 and the main body-side coupling member 27 in the thrust direction are restricted. Thus, as the cassette-side coupling member 25 is rotated in the arrow X' direction, the actuating plate 23 fixed to the rocking shaft 21 is laid flat along the bottom face of the cassette base 10.

When the actuating plate 23 is laid flat, the sheet stacking plate 20 reaches the bottom face of the cassette base 10, restricting the rotation of the cassette-side coupling member 25. Meanwhile, since the lift motor 30 continues to be rotated reverse, the main body-side coupling member 27 also continues to be rotated reverse, so that the second engaging surface 51 is driven to ride on the engaging rib 25*b*. In this case, one reaction force in a direction (arrow X direction) reverse to the rotational direction and another reaction force in the thrust direction (arrow Y2 direction) act from the engaging rib 25*b* on the main body-side coupling member 27.

As a consequence, due to the reaction forces in the reverse direction relative to the rotational direction (arrow X direction), there develops frictional force between the bearing hole 27*a* of the main body-side coupling member 27 and the rotating shaft 35*b* of the drive input gear 35. Movement of the main body-side coupling member 27 in the thrust direction (arrow Y2 direction) is restricted by setting the above-mentioned frictional force to such a magnitude that a resultant force by combination of the frictional force and a biasing force in the thrust direction (arrow Y1 direction) by the coil spring 43 becomes larger than the reaction force in the thrust direction (arrow Y2 direction) acting on the main body-side coupling member 27. As a result, by the component force in the thrust direction (arrow Y1 direction) that acts on the cassette base 10 via the cassette-side coupling member 25, the sheet feed cassette 1*a* is pushed out in the pull-out direction (arrow A' direction in FIG. 2) against the retaining force. That is, when the actuating plate 23 has come to a laid-down state, the engaging rib 25*b* is stopped from rotating, but the main body-side coupling member 27 continues to be rotated reverse, so that the engaging rib 25*b* slides in contact on the second engaging surface 51 of the main body-side coupling member 27. As a consequence, the engaging rib 25*b* is moved in the thrust direction (arrow Y1 direction), causing the sheet feed cassette 1*a* to be pushed out.

According to the configuration of this embodiment, when the sheets P stacked on the sheet stacking plate 20 have been emptied, the sheet feed cassette 1*a* is automatically projected in the pull-out direction against the retaining force. As a result of this, the user is allowed to pull out the sheet feed cassette 1*a* from the cassette type sheet feed part 101 with light force, so that replenishing work of the sheets P into the sheet feed cassette 1*a* can be fulfilled smoothly. Moreover, emptiness of sheets P in the sheet feed cassette 1*a* can be recognized with simplicity.

Also, only adjusting the shape of the engaging claws 27*b* of the main body-side coupling member 27 as well as the frictional force of the main body-side coupling member 27 against the rotating shaft 35*b* of the drive input gear 35 makes it possible to push out the sheet feed cassette 1*a*. Accordingly, the drive mechanism 61 for the sheet stacking plate 20 according to the prior art such as the lift motor 30, the idle gears 31 to 33, and the drive input gear 35 may appropriately be used as it is, so that cost increases due to design changes can be avoided.

Furthermore, even when jam (non-feed) of a sheet P has occurred in the cassette type sheet feed part 101, reverse rotating the main body-side coupling member 27 allows the sheet feed cassette 1*a* to be automatically pushed out. By virtue of this, occurrence of non-feed of paper sheets in the cassette type sheet feed part 101 can be easily recognized, so that the jam processing work can also be fulfilled smoothly.

Occurrence of any non-feed of paper sheets in the cassette type sheet feed part 101 can be detected by a sheet sensor 118 (second sensing mechanism, see FIG. 1) located in the sheet conveyance part 103, as an example. More specifically, when the sheet sensor 118 has sensed no passage of a sheet P within a certain time duration from a start of printing operation (paper-sheet feed operation), the controller 120 decides that non-feed of a paper sheet has occurred in the cassette type sheet feed part 101. Then, by a control signal from the controller 120, the lift motor 30 is continued being rotated reverse for a specified time, causing the sheet stacking plate 20 to be moved down. Thereafter, the main body-side coupling member 27 is rotated reverse so that the sheet feed cassette 1*a* is pushed out in the pull-out direction.

Otherwise, the present disclosure is not limited to the above-described embodiment, and may be carried out with various changes and modifications unless those changes and modifications depart from the gist of the disclosure. For example, although the first engaging surface 50 and the second engaging surface 51 are formed in the main body-side coupling member 27 in the above embodiment, yet the first engaging surface 50 and the second engaging surface 51 may instead be formed in the cassette-side coupling member 25.

The present disclosure is applicable to sheet feed devices which are fittable and removable to an apparatus body and which include a cassette for containing sheets to be fed to the apparatus body.

What is claimed is:

1. A sheet feed device comprising:

a sheet containing cassette including a sheet containing part for containing sheets therein, and a sheet stacking plate whose sheet-feed-direction downstream-side one end is pivotably supported by a bottom face of the sheet containing part and in which the sheets are to be stacked on its top surface;

a sheet feed part which is enabled to retain the sheet containing cassette in an insertable-and-withdrawable manner and to feed the sheets stacked on the sheet stacking plate with the sheet containing cassette set in a setting position;

a first sensing mechanism configured to sense presence or absence of the sheets stacked on the sheet stacking plate;

a lift mechanism provided in the sheet containing cassette and configured to move up and down the sheet stacking plate;

a drive mechanism provided in the sheet feed part and configured to transmit driving force to the lift mechanism; and a controller for controlling drive of the drive mechanism based on a sensing result by the first sensing mechanism, wherein the lift mechanism includes a cassette-side coupling member for transmitting driving force to an actuating plate that lifts up a sheet-feed-direction downstream-side end portion of the sheet stacking plate, the drive mechanism includes a main body-side coupling member to be coupled with the cassette-side coupling member, and when the first sensing mechanism senses the sheets stacked on the sheet stacking plate, the controller makes the main body-side coupling member rotate forward to move up the sheet stacking plate and moreover feed out a specified number of sheets; and during or after feeding of the sheets, when the first sensing mechanism has sensed that none of the sheets are stacked on the sheet stacking plate, the controller makes the main body-side coupling member rotate reverse to move down the sheet stacking plate and, even after the sheet stacking plate lowers to the bottom face, makes the main body-side coupling member continue to be rotated reverse so that pressing force in a thrust direction acts from the main body-side coupling member onto the cassette-side coupling member to move out the sheet containing cassette from the setting position.

2. The sheet feed device according to claim 1, wherein either one of the main body-side coupling member or the cassette-side coupling member has an engaging claw formed therein, the engaging claw including a first engaging surface perpendicular to a rotational direction of the main body-side coupling member, and a second engaging surface inclined at a specified angle relative to the rotational direction of the main body-side coupling member, the other of the main body-side coupling member or the cassette-side coupling member has an engaging piece formed therein so as to be engaged with the engaging claw, when the main body-side coupling member is rotated forward, the engaging piece is engaged with the first engaging surface so that the cassette-side coupling member is rotated forward, and when the main body-side coupling member is rotated reverse, the engaging piece is engaged with the second engaging surface so that the cassette-side coupling member is rotated reverse, causing the sheet stacking plate to be moved down, whereafter with the cassette-side coupling member stopped from rotating, the engaging piece is moved along an inclination of the second engaging surface, causing the cassette-side coupling member to be moved in the thrust direction, whereby the sheet containing cassette is moved out from the setting position.

3. The sheet feed device according to claim 2, wherein the drive mechanism includes a drive source, and a drive input gear for transmitting the driving force of the drive source to the main body-side coupling member, the main body-side coupling member is rotated integrally with a rotating shaft of the drive input gear and supported so as to be movable in the thrust direction on the rotating shaft, and movement of the main body-side coupling member in the thrust direction is restricted by frictional force developed between the main body-side coupling member and the rotating shaft.

4. The sheet feed device according to claim 3, wherein the rotating shaft has groove portions formed on an outer circumferential surface thereof, the main body-side coupling member has a bearing hole formed therein so as to allow the rotating shaft to be inserted thereinto, and protruding portions which is engaged with the groove portions are formed so as to extend in the thrust direction and face each other, respectively, on an inner circumferential surface of the bearing hole.

5. An image forming apparatus comprising:

the sheet feed device according to claim 1;

an image forming part configured to form an image on a sheet; and a sheet conveyance part located between the sheet feed device and the image forming part and serving for conveying the sheet fed out from the sheet feed device, to the image forming part.

6. The image forming apparatus according to claim 5, further comprising a second sensing mechanism configured to sense a passage of the sheet in the sheet feed part, wherein after a start of sheet feed operation, when the second sensing mechanism senses no passage of the sheet within a specified time, the controller makes the main body-side coupling member rotate reverse to move out the sheet containing cassette from the setting position.

* * * * *